US008579729B2

(12) United States Patent
Nelson et al.

(10) Patent No.: US 8,579,729 B2
(45) Date of Patent: Nov. 12, 2013

(54) WEDGE TYPE GOLF CLUB HEAD

(75) Inventors: Richard M. Nelson, Carlsbad, CA (US); Gregory D. Johnson, Carlsbad, CA (US); Kevin Tassistro, Escondido, CA (US); Douglas C. Jorgensen, San Diego, CA (US); Robert W. Vokey, Carlsbad, CA (US); Eddie G. Perez, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 365 days.

(21) Appl. No.: 12/957,562

(22) Filed: Dec. 1, 2010

(65) Prior Publication Data

US 2012/0129628 A1 May 24, 2012

Related U.S. Application Data

(63) Continuation-in-part of application No. 12/832,488, filed on Jul. 8, 2010, which is a continuation-in-part of application No. 12/474,316, filed on May 29, 2009, now Pat. No. 8,187,120.

(51) Int. Cl.
*A63B 53/04* (2006.01)

(52) U.S. Cl.
USPC ..... 473/350

(58) Field of Classification Search
USPC ..... 473/324–350
See application file for complete search history.

(56) References Cited

U.S. PATENT DOCUMENTS

| | | | | | |
|---|---|---|---|---|---|
| 1,835,718 | A | * | 12/1931 | Morton | 473/328 |
| 2,007,377 | A | * | 7/1935 | Link | 473/350 |
| 2,254,528 | A | * | 9/1941 | Hoare | 473/328 |
| D141,769 | S | * | 7/1945 | Newsome | D21/748 |
| 3,751,035 | A | * | 8/1973 | Lockwood | 473/290 |
| 4,211,416 | A | * | 7/1980 | Swanson | 473/242 |
| 5,011,151 | A | | 4/1991 | Antonious | |
| D327,109 | S | * | 6/1992 | Hardman et al. | D21/748 |
| 5,120,062 | A | * | 6/1992 | Scheie et al. | 473/314 |
| D329,481 | S | * | 9/1992 | Hunt | D21/750 |
| 5,326,105 | A | | 7/1994 | Fenton, Jr. | |
| 5,437,088 | A | | 8/1995 | Igarashi | |
| D362,887 | S | * | 10/1995 | Blough et al. | D21/747 |
| D364,435 | S | * | 11/1995 | Wood | D21/750 |
| D368,753 | S | * | 4/1996 | Blough et al. | D21/750 |
| 5,547,426 | A | * | 8/1996 | Wood | 473/290 |
| 5,643,106 | A | * | 7/1997 | Baird | 473/328 |
| 5,728,010 | A | * | 3/1998 | Hsu | 473/324 |
| 5,804,272 | A | | 9/1998 | Schrader | |

(Continued)

FOREIGN PATENT DOCUMENTS

| | | | |
|---|---|---|---|
| JP | 02265579 | A * | 10/1990 |
| JP | 09285571 | A * | 11/1997 |
| JP | 11146934 | A * | 6/1999 |

*Primary Examiner* — Alvin Hunter

(74) *Attorney, Agent, or Firm* — Randy K. Chang

(57) ABSTRACT

A wedge type golf club head is disclosed herein where the wedge type golf club head has enhanced performance characteristics such as improved backspin, ball speed, and launch angle. More specifically, the present invention relates to a wedge type golf club head having an adjustable center of gravity, where the center of gravity may be adjusted based on different backing profiles that comprises at least one hollow chamber. The wedge type golf club head disclosed above may also have a thickened topline, wherein the thickness of the topline progressively changes as a function of the loft angle of the wedge type golf club head.

17 Claims, 11 Drawing Sheets

(56) References Cited

U.S. PATENT DOCUMENTS

| | | | | |
|---|---|---|---|---|
| 6,015,354 | A | 1/2000 | Ahn et al. | |
| 6,045,455 | A | 4/2000 | Kosmatka et al. | |
| 6,530,846 | B1 * | 3/2003 | Mase | 473/290 |
| 6,641,491 | B1 | 11/2003 | Schillaci | |
| 6,679,784 | B2 * | 1/2004 | Mase | 473/290 |
| 6,719,642 | B2 * | 4/2004 | Wahl et al. | 473/291 |
| 6,860,819 | B2 * | 3/2005 | Gilbert | 473/291 |
| 6,872,153 | B2 | 3/2005 | Gilbert et al. | |
| 7,014,568 | B2 | 3/2006 | Pelz | |
| 7,186,187 | B2 * | 3/2007 | Gilbert et al. | 473/290 |
| 7,338,387 | B2 | 3/2008 | Nycum et al. | |
| 7,396,295 | B1 * | 7/2008 | Frame et al. | 473/337 |
| 7,513,835 | B2 * | 4/2009 | Belmont | 473/328 |
| 7,988,564 | B2 * | 8/2011 | Jertson | 473/290 |
| 2004/0127300 | A1 | 7/2004 | Roesgen et al. | |
| 2009/0176596 | A1 | 7/2009 | Kobayashi | |

* cited by examiner

WEDGE TYPE GOLF CLUB HEAD

CROSS-REFERENCE TO RELATED APPLICATION

The present application is a Continuation-In-Part of co-pending U.S. patent application Ser. No. 12/832,488, filed on Jul. 8, 2010, which is a Continuation-In-Part of U.S. patent application Ser. No. 12/474,316, filed on May 29, 2009 now U.S. Pat. No. 8,187,120; the disclosure of which are all incorporated by reference in their entirety.

FIELD OF THE INVENTION

The present invention relates generally to a wedge type golf club head with a lower center of gravity. More specifically, the present invention relates to a wedge type golf club head that has a high loft and a low center of gravity allowing for increased back spin, increased launch angle, and increased ball speed. In addition to the above, the present invention also discloses a golf club head with an increased topline thickness that varies with the loft of the golf club head.

BACKGROUND OF THE INVENTION

Golf clubs, combined with golf balls, have generally been considered to be the most essential equipment in the game of golf. Progressing in parallel with the development of the game of golf, significant developments have occurred within the golf equipment industry. Golf clubs, especially wedge type golf clubs, have also developed simultaneously with all other types of golf equipment to accommodate for the needs of the golfer to hit their shots more accurately and with more control.

Wedge type golf clubs, more commonly known as wedges, are a particular type of golf club that generally has a higher loft angle. These higher lofted wedges tend to be precision instruments that allow a golfer to dial in short range golf shots with improved trajectory, improved accuracy, and improved control. This increased loft angle in wedges generally yield a golf shot with a higher trajectory because of the impact surface with the golf ball is not perpendicular to the trajectory of the club head; but rather, the golf ball interacts with the wedge at an inclination closely resembling the actual loft angle of the wedge itself. This inclination generally causes the golf ball to move up along the inclination of the wedge when struck by the wedge type golf club head, creating a backward rotation of the golf ball as it leaves the wedge club face. This backwards rotation of the golf ball is generally known as "backspin" within the golf industry; and it is desirable in helping improve trajectory, accuracy, and control of a wedge type golf shot.

Backspin helps improve trajectory, accuracy, and control of a golf shot by giving the golf ball a gyroscopic effect, which stabilizes ball flight, hence increasing accuracy. Moreover, backspin also serves to increase control of a golf shot as backspin minimizes the roll of a golf ball after landing, creating a more predictable golf shot even after it lands on the ground.

A number of methods are generally known in the golf club art to increase backspin. For example, one method to generate increased backspin may be increasing the coefficient of friction of the wedge club face. U.S. Pat. No. 5,804,272 to Schrader titled Backspin Sticker ('272 patent) generally discloses a combination of a backspin sticker and a golf club having an angled surface for increasing the backspin of a golf ball when it hits the putting surface. More specifically, the '272 patent discloses a sticker, shaped to conform to a hitting area on the hitting surface, the sticker having a front surface with a coating of silicon carbide grain affixed with a synthetic resin and an adhering region having a clear, pressure sensitive adhesive applied thereon.

U.S. Pat. Pub. No. US 2004/0127300 to Roesgen et al. titled Golf Clubhead ('300 patent publication) is another example of a methodology used to increase backspin of a wedge type golf club by increasing coefficient of friction of the wedge club face. The '300 patent publication generally discloses a golf clubhead made from metal, having a strike face which has a loft angle $\alpha$ of greater than 45°, the strike face having a plurality of parallel grooves, where the strike face has a surface roughness Ra of less than 0.25 micrometer, and a Vickers hardness of the strike face greater than 5 Giga-Pascal.

Although the surface treatments discussed above may be effective in increasing the backspin of a golf ball, surface treatments often suffer from gradual wear and tear, making them less optimal. In order to address that issue, U.S. Pat. No. 7,014,568 to Pelz for a Golf Club ('568 patent) discloses a wedge face groove configuration that may also be beneficial in increasing backspin. More specifically, the '568 patent discloses a wedge hitting surface may take the form of an insert that includes a series of grooves, the design of which is varied from club to club to provide increasing friction with loft. Even more specifically, the wedges may utilize a club face of a constant surface roughness so that, regardless of club loft, the surface friction is kept constant and only the grooves of each club are varied to provide the changing impact friction required to provide constant spin rate.

U.S. Pat. No. 5,437,088 to Igarashi for a Method of Making a Golf Club that Provides Enhanced Backspin and Reduced Sidespin ('088 patent) also discloses a groove configuration that achieves increased backspin of a golf ball. More specifically, the '088 patent discloses an improved golf club wherein the surface of the face of the club is substantially flat, which is achieved by surfacing (milling) the club face, and wherein the edges of scoring lines (grooves) are made relatively sharp as a result of the surfacing operation. The sharp groove edges (and milling lines) of the present invention produce enhanced backspin and reduced sidespin when a golf ball is struck, which results in a relatively straight golf ball flight path, notwithstanding a glancing club impact angle.

As it can be seen from above, numerous attempts have been made to improve the backspin of a golf ball, especially when being hit with a wedge type golf club. However, the current methodology of utilizing either a surface treatment or groove configurations does not maximize the inherent potential of a wedge type golf club. More specifically, the current methodology does not take in to consideration the potential backspin and out going ball speed benefits that can be achieved by a wedge type golf club if the center of gravity (CG) location is shifted towards an alternate location that maximizes the efficiency of energy transfer between the wedge type golf club head and a golf ball.

FIG. 1, shows an exemplary wedge 100 in accordance with a prior art wedges wherein the location of the center of gravity (CG) 102 is at a distance d1 away from the ground 106. As shown FIG. 1, distance d1 denotes the location of the CG 102 of wedge 100 being a significant distance away from the ground 106. Distance d1, as shown in this exemplary prior art embodiment may generally be greater than 20 mm; however prior art wedges could have distance d1 be 21 mm, 22 mm, 23 mm, or any CG 102 location distance that is relatively high within a wedge without departing from exemplary prior art wedge 100.

Having a CG 102 location that is so high above ground 106 may generally be undesirable as it does not maximize the efficiency of energy transfer between the wedge type golf club head 100 and a golf ball. In order to maximize the efficiency of energy transfer between the wedge type golf club head 100 and a golf ball, it is generally desirable to have the CG 102 in closer proximity to the ground 106, and more preferably along an axis of impact perpendicular to the hitting surface that runs through the CG of the golf club and the center of the golf ball.

In addition to the increased backspin benefits that can be achieved by maximizing the CG location of a wedge type golf club, maximizing the CG location will also allow for increased performance characteristics such as increased ball speed and increased launch angle that correlates into increased trajectory, increased accuracy, and increased control. Increased ball speed will yield increased shot distance. If an increased spin is desired while keeping shot distance constant, the wedge loft will have to be increased, a characteristic which will mitigate the ballspeed increase while adding even more backspin to the ball, yielding even more overall stopping power or accuracy.

With respect to the ability of the golf club head to have an increased topline thickness that varies with the loft of the golf club head to improve the performance of the wedge type golf club head, the prior art, U.S. Pat. No. 5,547,426 to Wood discloses a golf club head using progressively sized heads having slots of selected depths in the back of the golf club head. These golf club heads may have a progressive top edge thickness so that all top edge appear to have the same width in use, but it makes no attempt to utilize and adjust this variation in topline thickness to improve the moment of inertia of the golf club head.

Hence, it can be seen that there is a need in the field for a golf club that is capable of improving the backspin characteristics without the need to either adjust the grooves or provide surface treatment to the wedge type club face. More specifically, there is a need in the field for a wedge type golf club that is capable of optimizing the performance characteristics of a golf shot such as backspin, ball speed, and launch angle by utilizing strategically placed CG locations within the wedge type golf club. The CG optimized wedge type golf club head that has improved performance characteristics may then be used in conjunction with a wedge type golf club head with various grooves or surface treatments to further optimize the backspin characteristics of a wedge type golf club head.

BRIEF SUMMARY OF THE INVENTION

In one aspect of the present invention is a wedge type golf club head comprising of a hosel and a body attached to the hosel, creating a loft angle. The body is further comprising of a hitting surface and a rear portion wherein the hitting surface defines a neutral axis perpendicular to the hitting surface passing through an impact point on the hitting surface. The wedge type golf club head also comprises of a sole at the bottom of the body at least partially resting on a ground connecting the hitting surface and the rear portion, wherein the loft angle is greater than about 45 degrees and wherein a center of gravity of the wedge type golf club head is located behind the hitting surface substantially along the neutral axis.

In another aspect of the present invention is a wedge type golf club head comprising of a hosel and a body attached to the hosel creating a loft angle, wherein the body comprises of a hitting surface and a rear portion. The wedge type golf club head also comprises of a sole at a bottom of the body at least partially resting on a ground connecting the hitting surface and the rear portion, wherein the loft angle is greater than about 45 degrees, wherein the sole further comprises of a weighted portion, and wherein a density of the weighted portion is greater than a density of the remainder of the wedge type golf club head.

In a further aspect of the present invention is a wedge type golf club head comprising of a hosel and a body attached to the hosel, creating a loft angle. The body is further comprising of a hitting surface and a rear portion wherein the hitting surface defines a neutral axis perpendicular to the hitting surface passing through an impact point on the hitting surface. The wedge type golf club head also comprises of a sole at the bottom of the body at least partially resting on a ground connecting the hitting surface and the rear portion, wherein the loft angle is greater than about 45 degrees, and wherein the center of gravity of the wedge type golf club head is located within a parabolic region of the wedge type golf club head that is bisected by the neutral axis. The parabolic region is further comprised of a vertex located at the impact point of the hitting surface and the open direction of the parabolic region is pointed towards the rear portion of the body of the wedge type golf club head.

In an even further aspect of the present invention is a wedge type golf club head comprising of a hosel and a body attached to the hosel, creating a loft angle. The body is further comprising of a hitting surface and a rear portion wherein the hitting surface defines a neutral axis perpendicular to the hitting surface passing through an impact point on the hitting surface. The wedge type golf club head also comprises of a sole at the bottom of the body at least partially resting on a ground connecting the hitting surface and the rear portion, wherein the loft angle is greater than about 45 degrees and wherein the wedge type golf club head has a Performance Ratio of greater than about 530,000 rpm*mph.

In an even further aspect of the invention is a wedge type golf club head that needs to have an added loft in order to mitigate the ballspeed increase produced by the lowered CG in the current wedge type golf club head. This will add additional backspin and keep the overall wedge shot distance constant; which is a desirable trait among players with relatively high swing speeds to club distances in the set doesn't overlap one another.

These and other features, aspects and advantages of the present invention will become better understood with references to the following drawings, description and claims.

BRIEF DESCRIPTION OF DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is the best currently contemplated modes of carrying out the invention. The description is not to be taken in a limiting sense, but is made merely for the purpose of illustrating the general principles of the invention, since the scope of the invention is best defined by the appended claims.

Various inventive features described below can each be used independently of one another or in combination with other features. However, any single inventive feature may not address any or all of the problems discussed above or may only address one of the problems discussed above. Further, one or more of the problems discussed above may not be fully addressed by any of the features described below.

Figure 2:
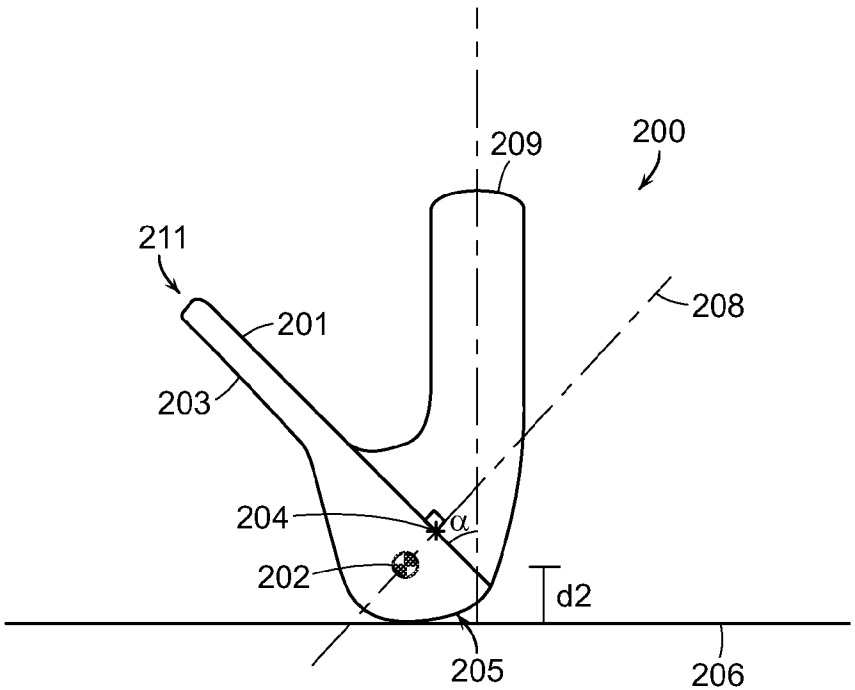
FIG. 2 shows a side view of a wedge type golf club head in accordance with an exemplary embodiment of the present invention.

FIG. 2 shows a side view of a wedge type golf club head 200 in accordance with an exemplary embodiment of the present invention having a specific center of gravity (CG) 202 location substantially along a neutral axis 208. Wedge type golf club head 200, as shown in the current exemplary embodiment, may contain a hosel 209 and a body 211 being attached to the hosel 209. The body 211 may be further comprised of a hitting surface 201 and a rear portion 203 connected by a sole 205 portion at the bottom of the wedge type golf club head 200. The sole 205, as shown in the current exemplary embodiment, generally has at least a portion of the sole 205 resting on the ground 206 at an angle formed by the sole 205 profile of the wedge type golf club head 200 when the golf club head is placed at address. The body 211, and more particularly the hitting surface 211, may be connected to the hosel at a loft angle $\alpha$ to create a lofted wedge type golf club head 200. The wedge type golf club head 200, as shown in the current exemplary embodiment, may have a neutral axis 208 that is perpendicular to the hitting surface 201, while passing through an impact point 204 on the hitting surface 201. The neutral axis 208 may generally be used to help determine the location of a center of gravity (CG) 202 of the wedge type golf club head 200, wherein the CG 202 location may generally be provided substantially along the neutral axis 208 behind the hitting surface 201. Finally, FIG. 2 shows the CG 202 being generally at a distance d2 from the ground 206 in accordance with the present invention.

Neutral axis 208, as shown in the current exemplary embodiment, may generally be an arbitrary line that is ninety degrees and perpendicular to the hitting surface 201. In addition to being perpendicular to the hitting surface 201, this neutral axis 208 may also generally pass through the hitting surface 201 at an impact point 204 in accordance with the present invention. The neutral axis 208 generally determines the path of travel of a golf ball after impacting the wedge type golf club head 200, and the neutral axis is further defined by the CG 202 location of the wedge type golf club head as the neutral axis 208 also passes through the CG 202 location.

Figure 1:
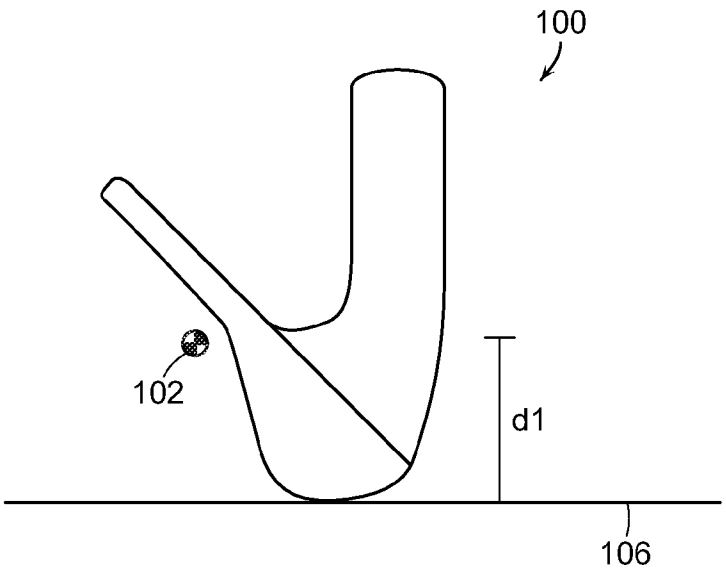
FIG. 1 (Prior Art)
FIG. 1 shows a side view of a prior art wedge type golf club head.

The wedge type golf club head 200, as shown in the current exemplary embodiment, may generally have a CG 202 location significantly lower than that of a prior art wedge type golf club head 100. (See FIG. 1). To put it in another way, the distance d2, as shown in FIG. 2 may generally be lesser than the distance d1 as shown in FIG. 1. More specifically, wedge type golf club head 200, as shown in the current exemplary embodiment, has the CG 202 location substantially along the neutral axis 208 instead of at an arbitrary location substantially above the neutral axis shown in FIG. 1. Even more specifically, FIG. 2 shows that CG 202 may be located directly on the neutral axis 208 and behind the hitting surface 201 and closer to the average impact point for most golfers with a wedge type golf club.

Having a CG 202 location directly on the neutral axis 208 may generally help improve the performance characteristics of a wedge type golf club head 200 by improving energy transfer efficiency and generate more momentum along the impact direction. This improved energy transfer generates more momentum and may directly improve the backspin, the ball speed, and the launch angle of a golf ball that is struck by the wedge type golf club head 200 irrespective of the grooves on the hitting surface 201 of the wedge type golf club head 200. It should be noted that significant improvements in the performance characteristics may be achieved just by having the CG 202 substantially along the neutral axis 208 and perfect alignment is not necessary. To achieve the significantly improved performance characteristic, the CG 202 location may be any location behind hitting face 201 and preferably at a location substantially along the neutral axis 208 in accordance with an embodiment of the present invention.

Impact point 204 may generally depict the point where a golf ball will come into contact with the wedge type golf club head 200. To put in another way, impact point may generally be the location where most golfers will hit a golf ball when utilizing a wedge type golf club head. Impact point 204, as shown in the current exemplary embodiment, may generally be 10 mm to 20 mm from ground 206; however, impact point 204 may be more preferably 12 mm to 18 mm from ground 206 or even more preferably from 14 mm to 16 mm from ground 206, and most preferably 15 mm from ground 206 all without departing from the scope and content of the present invention. The impact point 204, may help define the upper limit of the CG 202 location that is a distance d2 away from ground 206. Distance d2, as shown in the current exemplary embodiment may generally be less than 20 mm from ground 206, however, CG 202 location may more preferably be less than 18 mm from ground 206 or even more preferably less than 16 mm from ground 206, and most preferably less than 15 mm from ground 206 all without departing from the scope and content of the present invention.

Loft angle α, as shown in the current exemplary embodiment, may generally be directed towards a higher lofted club such as a wedge type golf club head 200. Wedge type golf club head 200, may generally have a loft angle α greater than 45 degrees; however loft angle α may be less then 45 degrees, or even exactly at 45 degrees all without departing from the scope and content of the present invention so long as the wedge type golf club head 200 could benefit from the enhanced performance that is achievable from the optimized CG 202 location associated with a wedge type golf club head 200.

Figure 4:
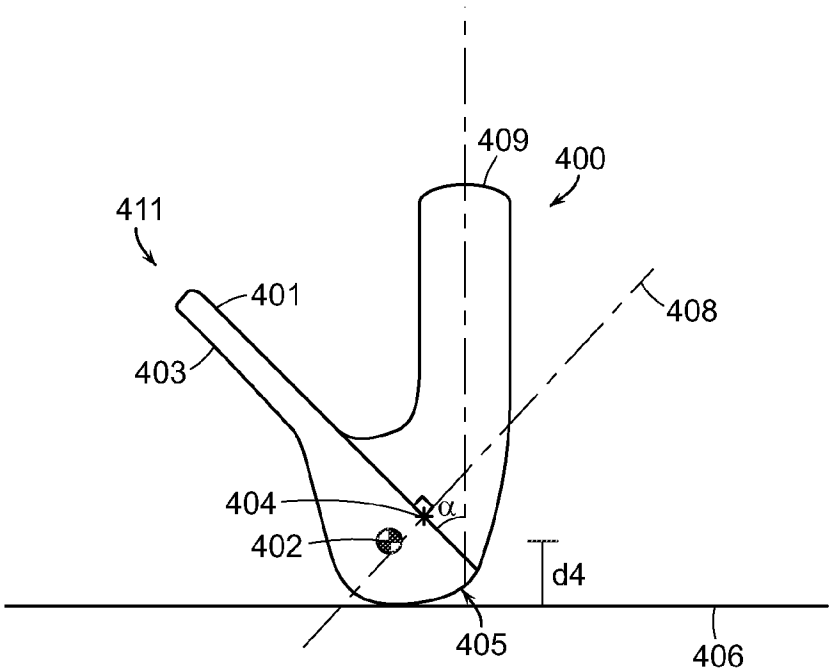
FIG. 4 shows a side view of a wedge type golf club head in accordance with a further alternative embodiment of the present invention.
Figure 3:
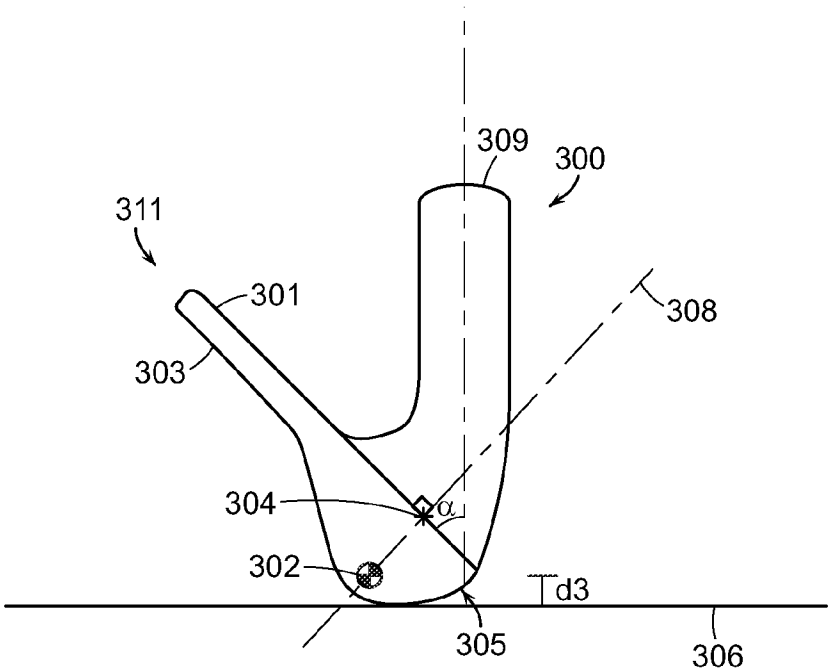
FIG. 3 shows a side view of a wedge type golf club head in accordance with an alternative embodiment of the present invention.

FIG. 3 shows an alternative embodiment of the present invention wherein wedge type golf club head 300, despite also having its CG 302 location substantially along the neutral axis 308, may have a distance d3 from the ground 306 that is significantly less than distance d2. Under this alternative embodiment shown in FIG. 3, wedge type golf club head may also have significantly improved performance characteristics such as backspin, ball speed, and launch angle because CG 302 is located directly on the neutral axis 308. Distance d3, as shown in the current exemplary embodiment may also generally be lower than the impact point 304, and may generally be less than 20 mm from ground 206, however, CG 302 location may more preferably be less than 18 mm from ground 306 or even more preferably less than 16 mm from ground 306, and most preferably less than 15 mm from ground 306 all without departing from the scope and content of the present invention. Wedge type golf club head 300, due to the CG 302 location, may generally improved energy transfer that generate more momentum may directly improve the backspin, the ball speed, and the launch angle of a golf ball FIG. 4 shows an even further alternative embodiment of the present invention wherein the wedge type golf club head 400 has a CG 402 location that is substantially along the neutral axis 408, but not directly on the neutral axis 408. Under this alternative embodiment shown in FIG. 4, the CG 402 may have a location that is slightly above the neutral axis 408, at a distance d4 away from ground 406, while still remaining substantially along the neutral axis 208. CG 402 location, although not directly on the neutral axis 408, is still capable of increasing the performance characteristics that generate more momentum and may directly improve the backspin, the ball speed, and the launch angle of a golf ball especially when compared to a prior art wedge 100, with its CG 102 location at a much higher location. (Shown in FIG. 1).

Figure 5:
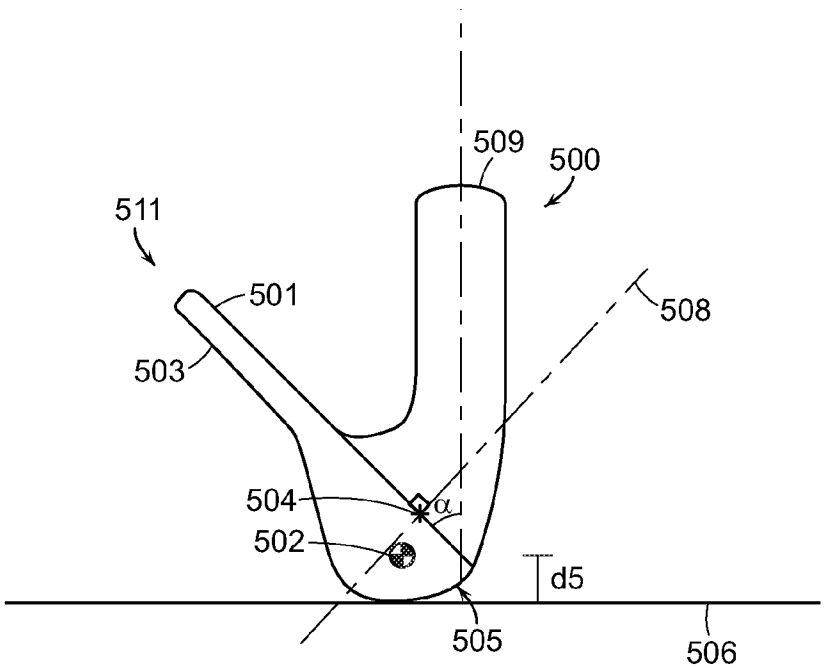
FIG. 5 shows a side view of a wedge type golf club head in accordance with a further alternative embodiment of the present invention.

FIG. 5 shows an even further alternative embodiment of the present invention wherein the wedge type golf club head 500 has a CG 502 location that is substantially along the neutral axis 508, but also not directly on the neutral axis 508. Under this alternative embodiment shown in FIG. 5, the CG 502 may have a location that is slightly below the neutral axis 508, at a distance d5 away from ground 506. CG 502 location, although not directly on the neutral axis 508, is still capable of increasing the performance characteristics that generates more momentum which may directly improve the backspin, the ball speed, and the launch angle of a golf ball especially when compared to a prior art wedge 100, with its CG 102 location at a much higher location. (Shown in FIG. 1)

Figure 6:
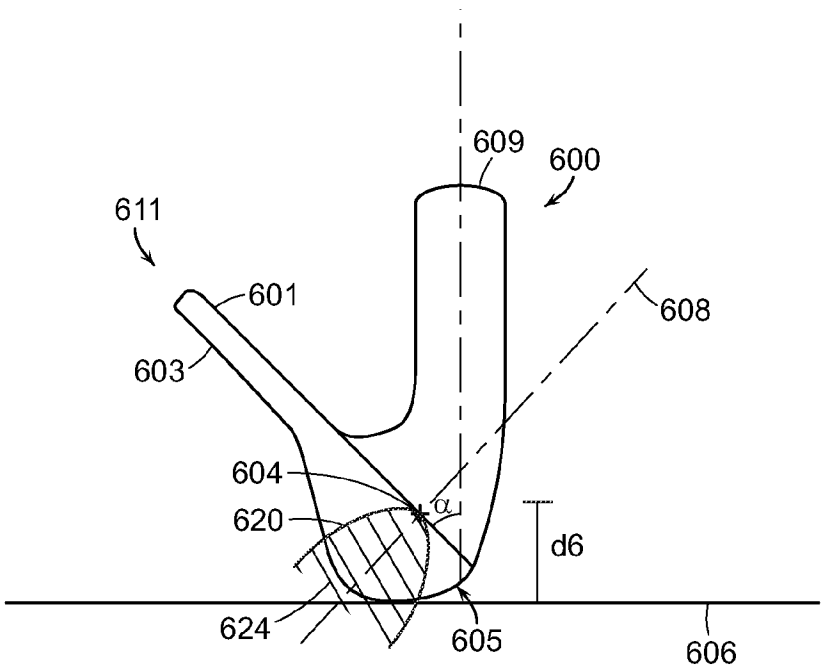
FIG. 6 shows a side view of a wedge type golf club head in accordance with the current invention wherein the range of the center of gravity CG location is shown.

As it can be seen from FIGS. 2-5, the CG may be located at various locations within wedge type golf club head, so long as it is substantially along the neutral axis, all in accordance with the scope and content of the present invention. FIG. 6 may generally characterize the boundaries of the potential CG location within a wedge type golf club head 600 that further clarifies the "substantially along" terminology in accordance with the present invention. FIG. 6 may show a wedge type golf club head 600 highlighting a parabolic region 620 that defines the boundaries of the potential CG location of a wedge type golf club head 600 in accordance with an exemplary embodiment of the present invention. Parabolic region 620 may have its vertex located at the impact point 604 and the parabolic region 620 may generally be bisected by the neutral axis 608 defining its location within the wedge type golf club head 600. Parabolic region 620 may generally have an open direction 624 directed towards the rear portion 603 of the body 611 while being slightly slanted towards the sole 605. Parabolic region 620 may generally define the boundaries for the location of a CG within wedge type golf club head 600, as the area encompassed by the parabolic region 620 may generally be considered to be "substantially along" the neutral axis 608 without departing from the scope and content of the present invention.

FIG. 6 may so show a distance d6, depicting the upper limit of the height of a potential CG location in accordance with the present invention. D6, as shown in the current exemplary embodiment may generally be the same height as impact point 604, which may generally be 10 mm to 20 mm from ground 606; however, impact point 604 may be more preferably 12 mm to 18 mm from ground 606 or even more preferably from 14 mm to 16 mm from ground 606, and most preferably 15 mm from ground 606.

The size of the parabolic region 620 may generally determine the CG locations that may be substantially along the neutral axis 608. More specifically, parabolic region 620, may generally define a region that will ensure that the CG location be within 7 mm of neutral axis 608; more preferably no greater than 5 mm; and most preferably no greater than 3 mm all without departing from the scope and content of the present invention. The perimeter of the parabolic region 620 may generally depict the region that will encompass the CG locations that will help achieve higher backspin, higher ball speed, and higher launch angle of a golf ball in accordance with the exemplary embodiment of the present invention.

The parabolic region 620 as shown in FIG. 6 may generally allow the CG to be located within a region that will improve performance to accommodate for different swing conditions generally associated with a golf swing. In order to optimize the swing conditions, it may generally be desirable to have the CG location be substantially along the neutral axis 608, which is based on the impact location 604. However, because different swings may generally create a different neutral axis 608 the optimal CG location will often vary with different swing characteristics. Because of the above mentioned swing variation, which can sometimes occur intentionally when a player de-lofts a club, the parabolic region 620 that defines the boundaries of the CG location will ensure the wedge type golf club head 600 will achieve optimal performance irrespective of the individual swings.

Figure 7:
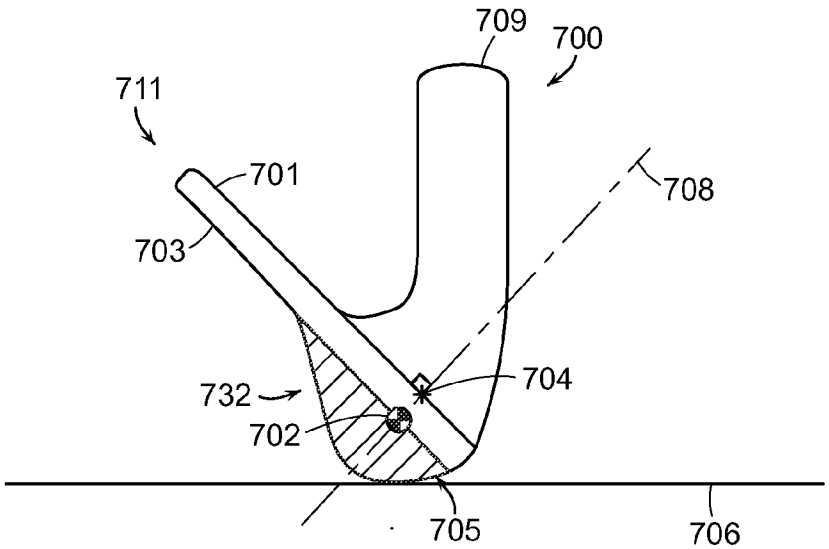
FIG. 7 shows a side view of an embodiment of the present invention showing the sole portion being made out of a weighted material.

FIG. 7 may serve to show the physical composition of a wedge type golf club head 700 that can be used to achieve a lower CG 702 location in accordance with the exemplary embodiments of the present invention. In order to achieve a lower CG 702 location, wedge type golf club head 700 may generally have a sole 705 that is further comprising of a weighted portion 732; wherein the weighted portion 732 may be comprised of a material that is denser than that of the remainder of the wedge type golf club head 700. The increased density of the weighted portion 732 may generally be used to lower the CG 702 of the wedge type golf club 700 to a location that is significantly lower than that of a prior art wedge 100. (Shown in FIG. 1)

Weighted portion 732, as shown in the current exemplary embodiment, may generally be comprised of a second material having a relatively high density such as tungsten; however, numerous other materials such as tungsten nickel, lead, copper, iridium, or any other material with a high density may all be used without departing from the scope and content of the present invention. The remainder of the wedge type golf club head 700, inversely, may generally be comprised of a standard material that has a lower density than that of the weighted portion 732. Wedge type golf club head 700, may generally be comprised of steel, however, numerous other materials such as aluminum, iron, copper, titanium, or even plastic so long as it has a density lower than that of the weighted portion 732 all without departing from the scope and content of the present invention.

In an exemplary embodiment of the present invention, weighted portion 732 may have a density of about 19300 kg/cubic meters when it is comprised of a material such as tungsten. Alternatively, the remainder of the wedge type golf club head 700 may have a density of about 7800 kg/cubic meters when it is comprised of a material such as steel. This relationship of the density between the weighted portion 732 and the remainder of the wedge type golf club head 700 may generally create a weight ratio that is greater than 2.0, more preferably greater than 2.25, and most preferably greater than 2.5; wherein the weight ratio is defined by the density of the weighted portion 732 over density of the remainder of the wedge type golf club head 700.

Weighted portion 732, as shown in FIG. 7, may replace the entire sole 705 of the wedge type golf club head 700 to create a lower CG 702 location; however, weighted portion 732 may only partially replace the sole 705 to achieve the desirable optimal CG 702 location without departing from the scope and content of the present invention. Wedge type golf club head 700, due to the improved CG 702 location that results from the weighted portion 732 may generally have a lower CG 702 location that improves energy transfer to generate more momentum that improves the backspin, the ball speed, and the launch angle of a golf ball based on the weighted portion 732.

Figure 8:
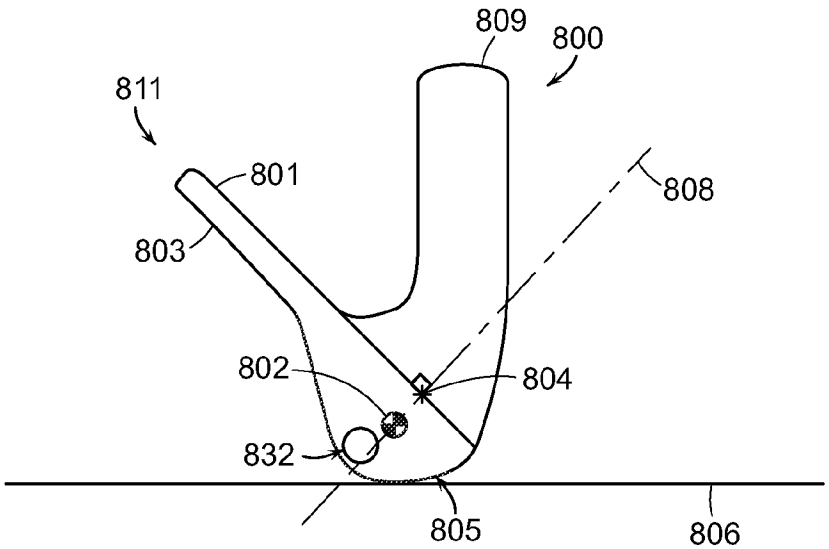
FIG. 8 shows a side view of a further alternative embodiment of the present invention showing the sole portion being partially made out of a weighted material.

FIG. 8 shows a wedge type golf club head 800 in accordance with a further alternative embodiment of the present invention wherein the weighted portion 832 only partially replaces the sole 805 to achieve the lower CG 802 location. FIG. 8 shows a weighted portion 832 resembling the shape of a cylindrical rod passing through the sole 805 of the wedge type golf club head 800 in order to achieve the desirable low CG 802 location. Weighted portion 832, although shown in the current exemplary embodiment as a cylindrical rod, may also be in various other shapes such as a rectangle, a triangular, a octagon, or any other shape that is capable of partially replacing the sole 805 with a material that is of a higher density all without departing from the scope and content of the present invention. It should be noted that in order to incorporate this weighted portion 832 within the golf club head 800, a chamber may be created in the sole 805 of the golf club head 800 to receive the weighted portion 832.

Figure 9:
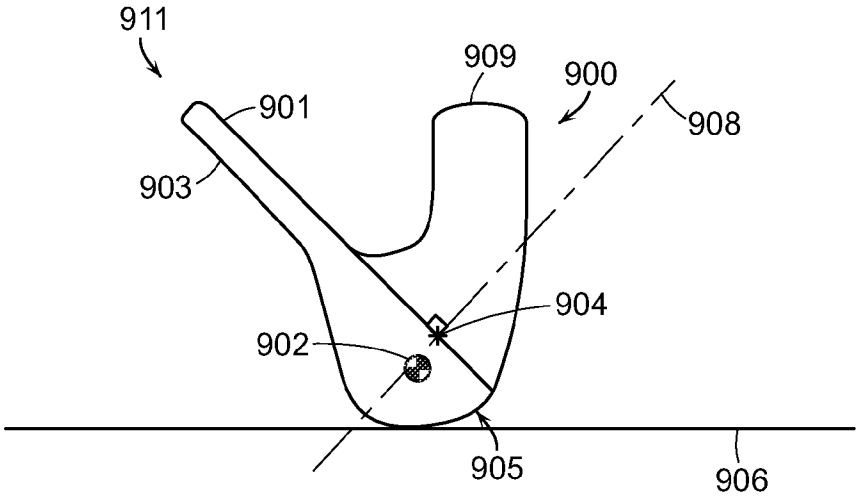
FIG. 9 shows a side view of a further alternative embodiment of the present invention showing a hosel with reduced length.

FIG. 9 shows another wedge type golf club head 900 in accordance with an even further alternative embodiment of the present invention wherein the hosel 909 has been shortened to help lower the CG 902 location within the wedge type golf club head 900. Shortening the hosel 909 removes weight that may generally be located high and away from the sole 905 of the club head, thus allowing the CG 909 to be lowered without the need of a weighted portion. However, it should be noted that the current invention could use a shortened hosel 909 in combination with a weighted portion in the sole to further lower the CG 909 of a wedge type golf club head 900.

Figure 10:
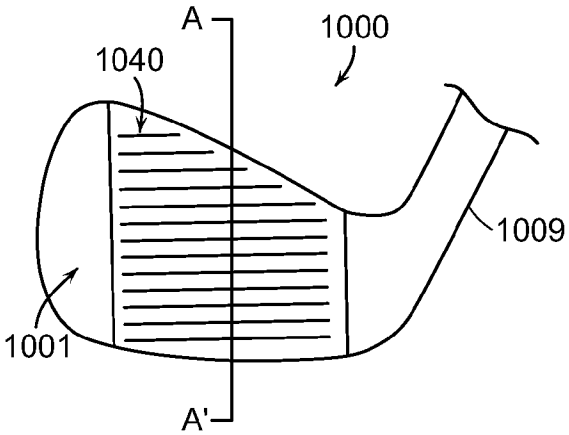
FIG. 10 shows a frontal view of an alternative embodiment of the present invention showing a hitting surface containing grooves.

FIG. 10 shows a front view of a wedge type golf club head 1000 in accordance with a further exemplary embodiment of the present invention showing a hosel 1009 and a plurality of grooves 1040 on the hitting surface 1001 of the wedge type golf club head 1000. Plurality of grooves 1040 may generally be of various shape and sizes and made utilizing various processes as shown in more detail in FIG. 11 without departing from the scope and content of the present invention.

Figure 11:
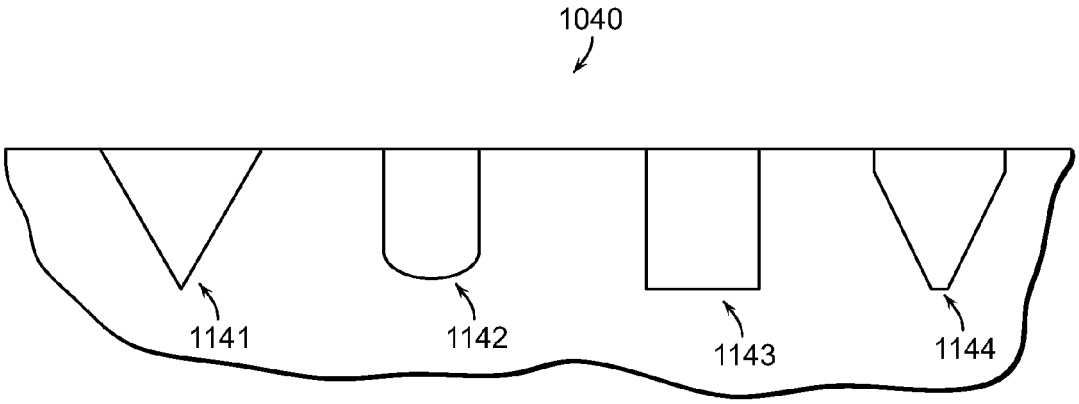
FIG. 11 shows multiple cross-sectional views of groove configurations in accordance with the present invention.

FIG. 11 shows a cross-sectional view of the various embodiments that may be used for the plurality of grooves 1040. Plurality of grooves 1040 may be V-shaped as shown by groove 1141, U-shaped as shown by groove 1142, square shaped as shown by groove 1143, hybrid shaped as shown by groove 1145, or any other groove shape that is capable of improving the coefficient of friction of the wedge type golf club. Moreover, the various groove configurations shown by groove 1141, groove 1142, groove 1143, and groove 1145 may be constructed out of various method such as spin milled, stamped, forged, or any other manufacturing process capable of producing the grooves to help the performance characteristics.

Figure 12:
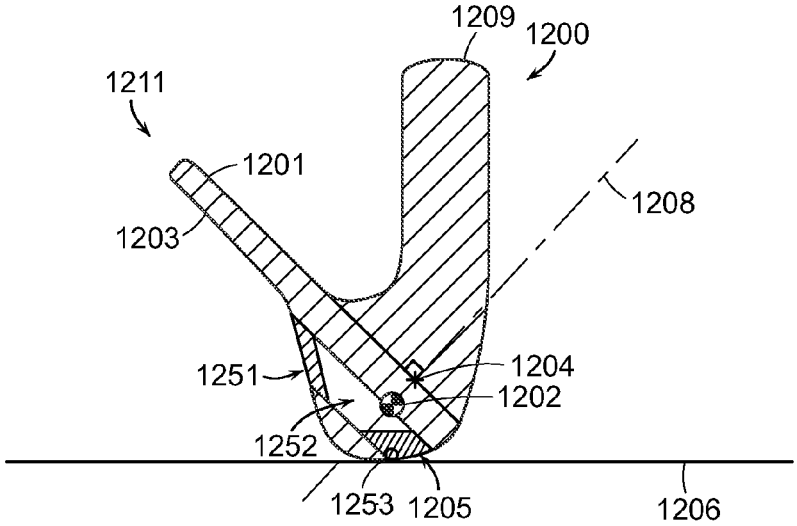
FIG. 12 shows a cross-sectional view of a further alternative embodiment of the present invention showing a different sole profile.

FIG. 12 shows a cross-sectional view of a wedge type golf club head 1200 taken along cross-sectional line A-A' in FIG. 10 to show a further alternative embodiment of the present invention. Wedge type golf club head 1200, as shown in the current alternative embodiment utilizes a partially hollow rear portion 1203 forming a cavity 1252 that may further contain a weighted portion 1253, and covered by a lid 1251. This cavity 1252 portion, which takes away weight from the wedge type golf club head 1200, may serve to help eliminate weight in the rear portion 1203 of the wedge type golf club head 1200 to help lower the CG 1202 location closer to ground 1206. In addition, to the cavity 1252 portion, the weighted portion 1253 that may generally be comprised of a high density material, may help further lower the CG 1202 location closer to ground 1206. The lowered location of CG 1202, once again, may help better align the CG 1202 with the neutral axis 1208, which in turn helps achieve the enhanced performance characteristics such as improve trajectory, accuracy, and control that results from greater backspin. Wedge type golf club head 1200, due to the improved CG 1202 location, may generally improve energy transfer to generate more momentum that directly improves the backspin, the ball speed, and the launch angle of a golf ball.

FIGS. 7, 8, 9, and 12 all show various methodology that may be used to utilize a weighted portion at the sole of a wedge type golf club head to lower the CG location lower than those of a traditional type wedge type golf club head 100 in order to improve the performance characteristics. More specifically, FIGS. 7, 8, 9, and 12 all lower the CG to a location substantially along the neutral axis within the parabolic region 620 (see FIG. 6) in an attempt to improve the backspin and performance characteristics of a wedge type golf club head. It should be noted that FIGS. 7, 8, 9, and 12 only show exemplary methodology that may be used to lower the CG location, and various combinations of the methodology used in FIGS. 7, 8, 9, and 12, or even other methodology not disclosed in FIGS. 7, 8, 9, and 12 may all be used so long as it shifts the CG location within the parabolic region 620 (see FIG. 6) without departing from the scope and content of the present invention.

Finally, it should be noted that because a wedge type golf club head in accordance with the present invention performs so well beyond the actual loft that it is labeled with and measured at, the labeling of the loft angle may need to be adjusted to maintain the same performance numbers previously associated with various wedge type golf club heads. For example, a 55 degree wedge in accordance with the current exemplary invention could very easily achieve performance numbers traditionally associated with a prior art 54 degree wedge without the optimized CG location.

Figure 13:
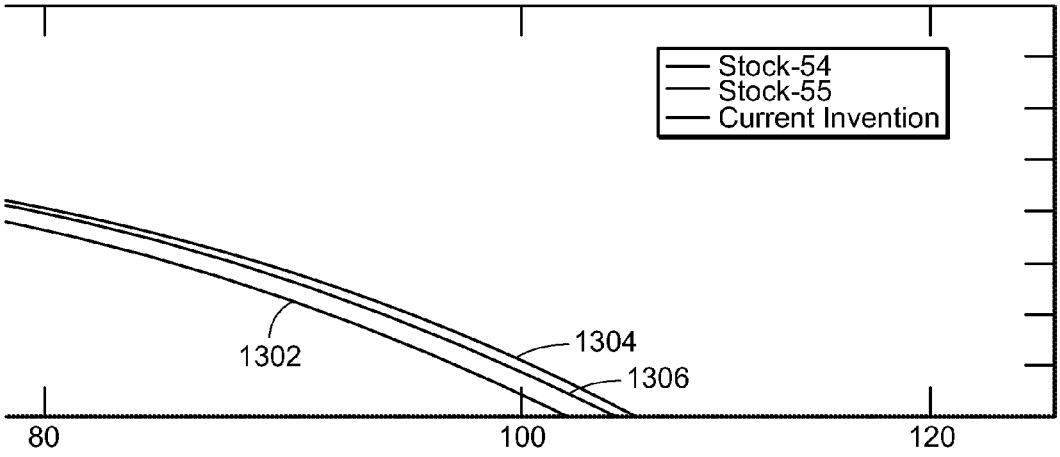
FIG. 13 shows a graphical representation of flight conditions of a golf ball after being struck by various wedge type golf club heads.

FIG. 13 shows a graphical representation of a simulated trajectory for a stock 54 degree wedge in accordance with prior art wedges, a stock 55 degree wedge in accordance with a prior art wedge, and a CG modified 55 degree wedge in accordance with the current invention. Flight path 1302, as shown in FIG. 13, may generally represent a flight trajectory of a stock 54 degree wedge in accordance with the prior art wedge. Flight path 1304, as shown in FIG. 13, may generally represent a flight trajectory of a stock 55 degree wedge in accordance with a prior art wedge. Finally, flight path 1306, as shown in FIG. 13, may generally represent a flight trajectory of a CG modified 55 degree wedge in accordance with the current invention. FIG. 13 may demonstrate through various flight paths that a wedge in accordance with the present invention may be able to achieve increased performance characteristics such as improved backspin, increased ball speed, and increased launch angle similar to those having a lower loft without departing from the scope and content of the present invention.

As it can be seen from FIG. 13, a wedge type golf club head in accordance with the present invention may generally have performance features that are a significant improvement over prior art wedges. Although it may generally be desirable to increase the distance of a golf shot, this improved distance gain in the wedge type golf club head in accordance with the present invention may not be desirable, as accuracy and distance control are more important in a wedge type golf shot. Hence, in order to maintain the same distance, a wedge type golf club head in accordance with the present invention may need to have additional loft to achieve the same distance. This wedge type golf club head with an increased loft may generally be capable of achieving the same distance as a wedge that has a baseline loft value, but do so with an improved trajectory that yields maximum distance control. Improved trajectory, as achieved by a wedge type golf club head in accordance with the present invention, will have a higher launch with more spin yielding a steeper angle of descent allowing more predictability upon landing. "Drop and stop" may generally be a special term of art used by golfers to describe this increased predictability upon landing. This improved predictability is important in a wedge type golf shot, as it is generally a wedge type club is chosen for its accuracy in attacking the pin.

Although FIG. 13 shows that a CG optimized wedge in accordance with the present invention may generally achieve a flight path similar to a prior art wedge that is one degree less lofted; a CG optimized wedge in accordance with the present invention may be able to achieve flight path characteristic similar to a prior wedge that is two degrees less, three degrees less, or any number of degrees less all without departing from the scope and content of the present invention.

Finally, returning to FIG. 2, a wedge type golf club head 200 in accordance with the present invention is shown having the CG 202 located substantially along the neutral axis 208 that may generally help improve the performance characteristics of the wedge type golf club head 200; particularly when compared to a prior art wedge type golf club head 100. (See FIG. 1) More specifically, wedge type golf club head 200 may have an improvement in a Performance Ratio of the wedge type golf club head that is greater than 15,000 rpm*mph, more preferably greater than 20,000 rpm*mph, and most preferably greater than 21,000 rpm*mph. Performance Ratio, as defined in the current invention may generally be defined by equation (1) below.

$$\text{Performance Ratio} = \frac{(\text{Launch Angle}) * (\text{Ball Speed}) * (\text{Backspin})}{\text{Loft}} \quad (1)$$

Described below for comparative purposes, a prior art wedge type golf club head 100 may have a launch angle of about 27.1 degrees, a ball speed of about 86.9 mph, a backspin rate of about 12138 rpm, and a loft of about 54 degrees; yielding a Performance Ratio of approximately 529,349 rpm*mph. Wedge type golf club head 200, in accordance with an exemplary embodiment of the present invention, may generally have a launch angle of about 27.4 degrees, a ball speed of about 88.2 mph, a backspin rate of about 12330 rpm, and a loft of about 54 degrees; yielding a Performance Ratio of approximately 551,808 rpm*mph. The change in Performance Ratio from a prior art wedge type golf club head 100 to wedge type golf club head 200, as shown in the current exemplary embodiment, may be approximately 22,459 rpm*mph signifying an increased of performance characteristic without departing from the scope and content of the present invention.

Figure 14:
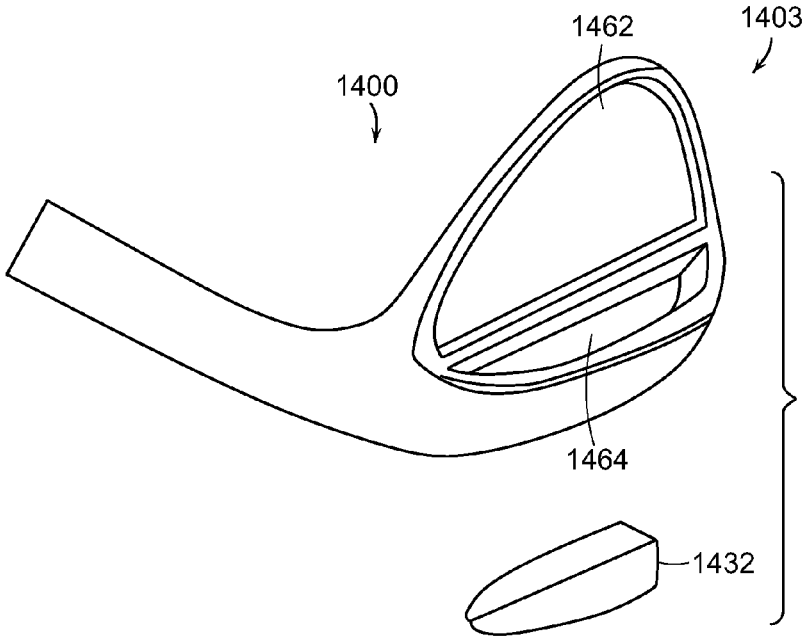
FIG. 14 shows a perspective view of a golf club head in accordance with a further alternative embodiment of the present invention.

FIG. 14 of the accompanying drawings shows a perspective view of a golf club head 1400 in accordance with a further alternative embodiment of the present invention. More specifically, golf club head 1400 shown in FIG. 14 may have two different hollow chambers at the rear portion 1403 of the golf club head 1400 providing a different way to adjust the CG of the golf club head 1400. Even more specifically, the rear portion 1403 of the golf club head 1400 may have an upper chamber 1462 near the upper segment of the golf club head 1400 and a lower chamber 1464 at the bottom segment of the golf club head 1400. The upper chamber 1462 reduces unnecessary weight from the top of golf club head 1400, allowing CG of the golf club head to be lowered. The hollow lower chamber 1464, on the other hand, may generally be filled in with a denser second material to create a weighted portion 1432 that serves to further lower the CG of the golf club head 1400.

Figure 15:
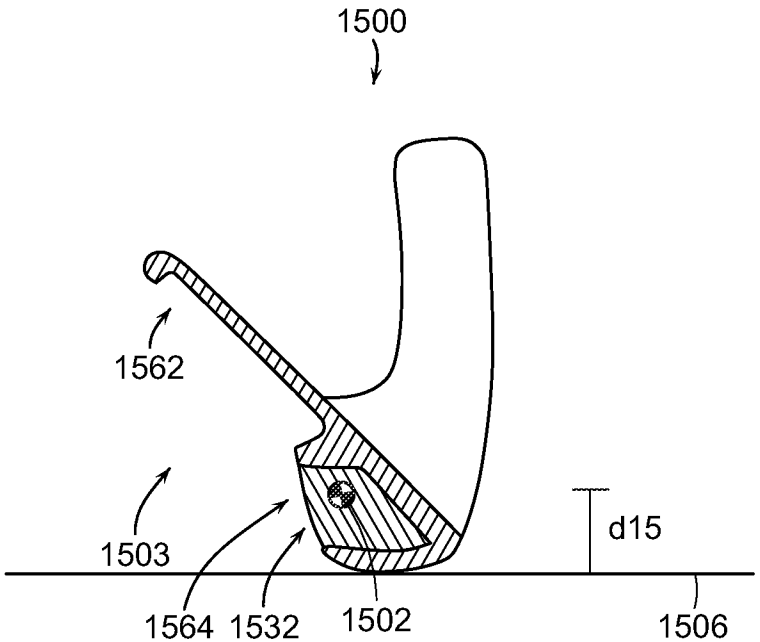
FIG. 15 shows a cross-sectional view of the golf club head shown in FIG. 14.

FIG. 15 of the accompanying drawings shows a cross-sectional view of the golf club head 1400 shown in FIG. 14, taken across the middle of the golf club head 1400. The cross-sectional view of the golf club head 1500 shown in FIG. 15 allows the geometry of the backing portion 1503 to be shown more clearly in conjunction with the location of the CG 1502. In the current exemplary embodiment shown in FIG. 15, the upper chamber 1562 may be hollow while the lower chamber 1564 may be filled with a denser second material to create a weighted portion 1532 to lower the CG 1502 of this golf club head. It should be noted that in this exemplary embodiment, the CG 1502 location may generally be at a distance d15 away from the ground 1506. Distance d15, as shown in this current exemplary embodiment, may generally be greater than about 16 mm and less than about 20 mm, more preferably greater than about 17 mm and less than about 19 mm, most preferably be about 18 mm. In an alternative embodiment of the present invention, the weighted portion 1532 may take on a different shape or size if the upper chamber 1562 and the lower chamber 1564 take on a different size to further adjust the CG 1502 of the golf club head 1500 without departing from the scope and content of the present invention.

Figure 16:
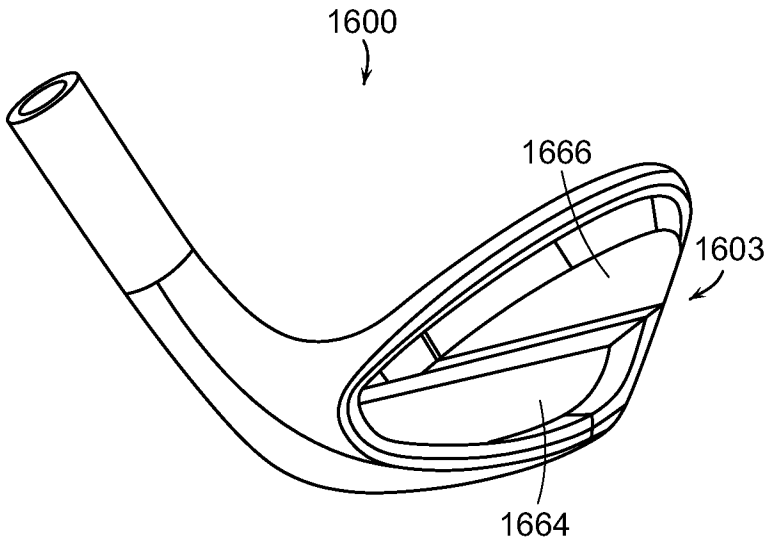
FIG. 16 shows a perspective view of a golf club head in accordance with a further alternative embodiment of the present invention.

FIG. 16 of the accompanying drawings shows a perspective view of a golf club head 1600 in accordance with a further alternative embodiment of the present invention. More specifically, golf club head 1600 may have a thickened upper portion 1666 instead of an upper chamber to help raise the CG of the golf club head 1600. It should be noted that in this alternative embodiment, the lower chamber 1664 may or may not be filled with a secondary material that is denser than the remainder of the golf club head. When the lower chamber 1664 is filled with a denser secondary material, the denser secondary material helps bring the CG location lower. Alternatively, when the lower chamber 1664 is left hollow, the thickened upper portion 1666 helps raise the CG location of the golf club head 1600.

Figure 17:
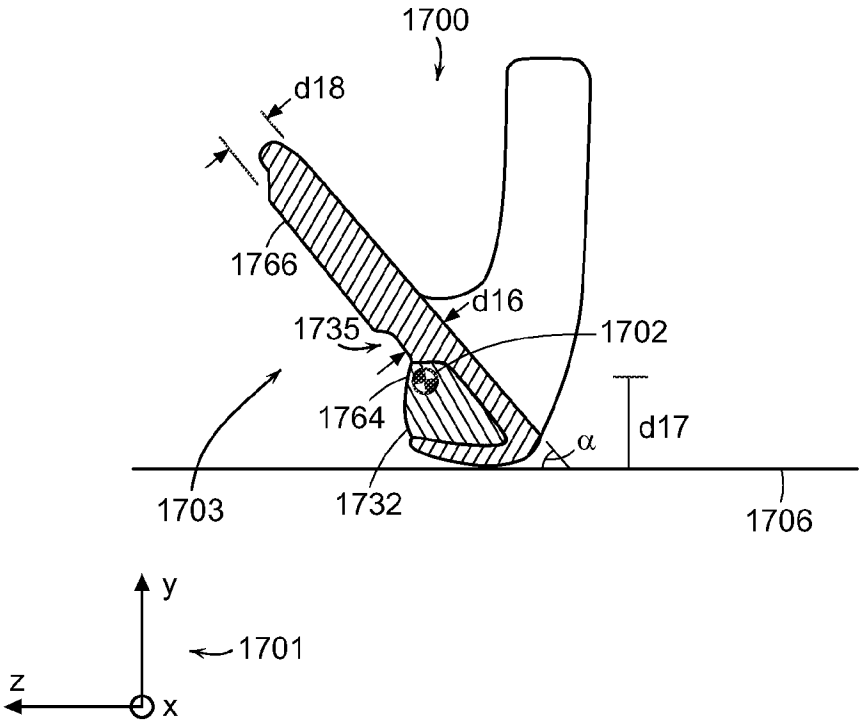
FIG. 17 shows a perspective view of the golf club head shown in FIG. 16.

FIG. 17 of the accompanying drawings shows a cross-sectional view of the golf club head 1600 shown in FIG. 16, taken across the middle of the golf club head 1600. The cross-sectional view of the golf club head 1700 shown in FIG. 17 allows the geometry of the backing portion 1703 to be shown more clearly in conjunction with the location of the CG 1702. The thickened upper portion 1766 of the golf club head 1700 shown in FIG. 17 may generally have a first thickness d18 of greater than about 4.8 mm and less than about 7.1 mm, more preferably greater than about 5.33 mm and less than about 6.6 mm, most preferably about 5.84 mm. This thickened upper portion, as defined in the current exemplary embodiment of the present invention, may generally refer to the thickest portion of the golf club head 1700 that is substantially near the top portion of the golf club head 1700. The cross-sectional view of golf club head 1700 shows a CG 1702 location that results when the lower chamber 1764 is filled with a secondary material that has a higher density to create a weighted portion 1732. It should be noted that if the lower chamber 1764 is left hollow and unfilled, the CG 1702 location may generally be significantly higher. In addition to the above, FIG. 17 of the accompanying drawings also shows a second thickness d16 of the thinned portion 1735 of the golf club head 17, wherein d16 may generally be less than about 6.5 mm, more preferably less than about 6.0 mm, and most preferably less than about 5.8 mm.

In the exemplary embodiment of the golf club head 1700 shown in FIG. 17, the thickened upper portion 1766 may improve the performance of the golf club head 1700 by improving the stability of the golf club head 1700 as it impacts a golf ball. In order to initiate a discussion on the stability of a golf club head 1700, also known as the Moment of Inertia (MOI), a brief explanation of the coordinate system may be necessary. FIG. 17 of the accompanying drawings shows a coordinate system 1701, depicting the y-axis running in a substantially vertical direction, a z-axis running in a horizontal and front to back direction, and a x-axis running in a direction that is stems substantially in a heel to toe direction. The improved stability of the golf club head 1700 discussed here may generally relate to the MOI number about the x-axis of the golf club head 1700 to prevent the golf club head from twisting when the golf club strikes a golf ball at different heights. The MOI of the golf club head 1700 about the x-direction may generally be greater than about 120 kg*mm$^2$, more preferably greater than about 125 kg*mm$^2$, and most preferably greater than about 129 kg*mm$^2$.

In addition to preventing the golf club head from twisting for shots at different heights above the neutral axis, this improved MOI will also improve the performance of the golf club head by preventing a golf ball from sliding up the face of the golf club head 1700 during impact. Because wedge type golf club head may generally have a higher loft angle $\alpha$, a golf ball that contacts the hitting surface of the golf club head 1700 will be more likely to slide up the face of the golf club head 1700 during impact. Having a golf club head 1700 with a higher moment of inertia along the x-axis will allow the golf club head 1700 to remain steady during impact with a golf ball even at different impact heights, minimizing any movement of the golf club head 1700 despite this higher loft angle $\alpha$.

Because the actual first thickness d18 of the thickened upper portion 1766 may be one of the more important factors that affect the MOI of a golf club head 1700 along the x-axis, the exact first thickness d18 of the thickened upper portion 1766 may need to be defined relative to the loft $\alpha$ of the golf club head 1700. Hence, in order to quantify this specific relationship between the thickness d18 and the loft $\alpha$, a "Topline Thickness Ratio" may be defined as shown below by equation (2) below:

$$\text{Topline Thickness Ratio} = \frac{\text{Loft } (\alpha) \text{ of Golf Club Head}}{\text{First Thickness } (d18) \text{ of Golf Club Head}} \quad (2)$$

"Topline Thickness Ratio", as demonstrated by the current exemplary embodiment of the present invention, may generally be greater than about 6.0 degrees/mm and less than about 9.0 degrees/mm, more preferably greater than about 7.0 degrees/mm and less than about 9.0 degrees/mm, and most preferably greater than about 8.0 degrees/mm and less than about 9.0 degrees/mm. The Topline Thickness Ratio of the current inventive golf club head compared to a prior art golf club head can be found in Table 1 below.

TABLE 1

| | Inventive Golf Club Head | | | | Prior Art Golf Club Head #1 | |
|---|---|---|---|---|---|---|
| Loft | First Thickness (d18) - (mm) | Second Thickness (d16) - (mm) | Thickness Difference (d18/d16) - (mm) | "Topline Thickness Ratio" - (degrees/mm) | Topline Thickness - (mm) | "Topline Thickness Ratio" (degrees/mm) |
| 46 | 5.60 | 5.20 | 0.40 | 8.214 | 5.20 | 8.846 |
| 48 | 5.60 | 5.20 | 0.40 | 8.571 | 5.20 | 9.231 |
| 50 | 6.10 | 5.33 | 0.77 | 8.197 | 5.33 | 9.381 |
| 52 | 6.10 | 5.33 | 0.77 | 8.525 | 5.33 | 9.756 |
| 54 | 6.48 | 5.50 | 0.98 | 8.333 | 5.50 | 9.818 |
| 56 | 6.48 | 5.50 | 0.98 | 8.642 | 5.50 | 10.182 |
| 58 | 7.06 | 5.70 | 1.36 | 8.215 | 5.70 | 10.175 |
| 60 | 7.06 | 5.70 | 1.36 | 8.499 | 5.70 | 10.526 |
| 62 | 7.32 | 5.59 | 1.73 | 8.470 | 5.59 | 11.091 |
| 64 | 7.32 | 5.59 | 1.73 | 8.743 | 5.59 | 11.449 |

Although somewhat related to the Topline Thickness Ratio, it is worth recognizing here that Table 1 also shows the first thickness d18 getting progressively thicker as the loft α of the golf club head 1700 increases. This progressive increase in the first thickness d18 of the thickened upper portion 1766 is important to the performance of the golf club head 1700 because the higher lofted golf club heads would generally require a thicker upper portion 1766 to provide more stability.

In addition to the thickness d18 of the thickened upper portion 1766, table 1 above also shows the second thickness d16 of the thinned portion 1735 of the golf club head 1700. Second thickness d16 may be used to calculate a thickness difference of the rear portion of the golf club head, which provides an alternative methodology to quantify the increasing thickness d16 as it relates to the remainder of the golf club head 1700. A golf club head 1700 in accordance with the current exemplary embodiment of the present invention may generally have a thickness difference of greater than about 0.4 mm, more preferably greater than about 1.0 mm, and most preferably greater than about 1.5 mm. This thickness difference can then be used to calculate a "Thickness Difference Ratio", which provides an alternative way to capture the performance enhancements of the golf club head 1700, defined by equation (3) below:

$$\text{Thickness Difference Ratio} = \frac{\text{Loft } (\alpha) \text{ of Golf Club Head}}{\text{Thickness Difference}} \qquad (2)$$

Thickness Difference Ratio, as it can be seen from above, provides a relationship between the loft of the golf club head 1700 and the thickness difference. The golf club head 1700 in accordance with the exemplary embodiment of the present invention may generally have a Thickness Difference Ratio of greater than 25 degrees/mm, more preferably greater than 27.5 degrees/mm, and most preferably greater than 30 degrees/mm.

Figure 18:
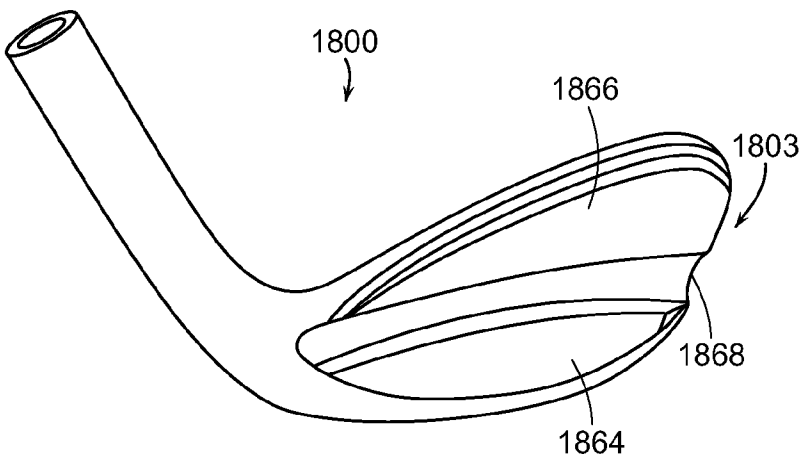
FIG. 18 shows a perspective view of a golf club head in accordance with a further alternative embodiment of the present invention.

FIG. 18 of the accompanying drawings shows a perspective view of a golf club head 1800 in accordance with a further alternative embodiment of the present invention. More specifically, golf club head 1800 may have different geometry for the thickened upper portion 1866 near the top of the backing portion 1803 of the golf club head 1800. In addition to the thickened upper portion 1866, the golf club head 1800 may also have a lower chamber 1864 at the bottom of the backing portion 1803 of the golf club head 1800. Finally, golf club head 1800 may also have a channel 1868 near the center of the backing portion 1803 of the golf club head 1800 between the thickened upper portion 1866 and the lower chamber 1864. The channel 1868 shown in FIG. 18 may generally serve the purpose of accentuating the CG fluctuations due to the thickened upper portion 1866 and the lower chamber 1864 as it removes material from the center of the golf club head 1800.

Figure 19:
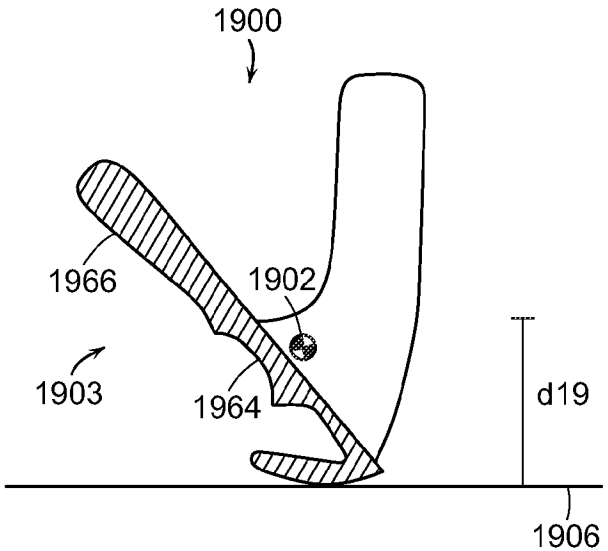
FIG. 19 shows a cross-sectional view of the golf club head shown in FIG. 18.

FIG. 19 of the accompanying drawings shows a cross-sectional view of the golf club head 1800 shown in FIG. 18, taken across the middle of the golf club head 1800. The cross-sectional view of the golf club head 1900 shown in FIG. 19 allows the geometry of the backing portion 1903 to be shown more clearly. It should be noted that in this current exemplary embodiment of the present invention the lower chamber 1964 may be hollow without departing from the scope and content of the present invention. Because the lower chamber 1964 is not filled with a denser material, the CG 1902 location of the golf club head 1900 may be at a distance d19 that is significantly further away from the ground 1906. Distance d19 in this exemplary embodiment of the present invention may be greater than about 18 mm and less than about 22 mm, more preferably greater than 19 mm and less than about 21 mm, more preferably about 21 mm all without departing from the scope and content of the present invention.

Figure 20:
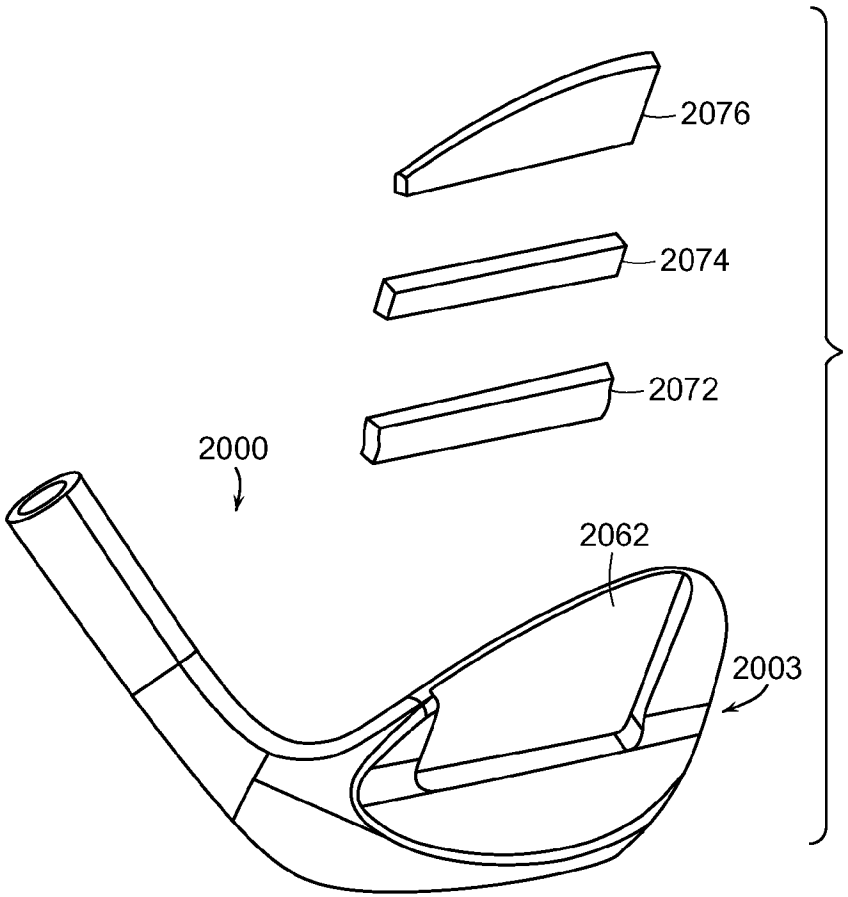
FIG. 20 shows a perspective view of a golf club head in accordance with a further alternative embodiment of the present invention.

FIG. 20 of the accompanying drawings shows a perspective view of a golf club head 2000 in accordance with a further alternative embodiment of the present invention wherein the backing portion 2003 of the golf club head 2000 may contain an oversized upper chamber 2062 that allows multiple inserts to be inserted into the upper chamber 2062. More specifically, the multiple inserts may be comprised of a bottom insert 2072, a central insert 2074, and a top insert 2076. In one exemplary embodiment of the present invention the bottom insert 2072 may be comprised out of a material having a higher density such as tungsten while the central insert 2074 and the top insert 2076 may be comprised out of a material or materials having a lower density in order to create a golf club head 2000 with a lower center of gravity. In an alternative embodiment of the present invention, top insert 2076 may be comprised out of a material having a higher density while the central insert 2074 and the bottom insert 2072 may be comprised out of a material having a lower density to create a golf club head 2000 with a higher density in order to create a golf club head 2000 with a higher center of gravity. In a further alternative embodiment of the present invention, central insert 2074 may be comprised out of a material having a higher density such as tungsten while the bottom insert 2072 and the top insert 2076 may be comprised out of a material or materials having a lower density in order to create a golf club head 2000 with more traditional center of gravity of location.

One advantage of the golf club head 2000 shown in FIG. 20 is that such a golf club head allows its CG location to be changed easily by altering the different materials used to create the inserts. Additionally, although the higher density material discussed above may refer to tungsten, numerous other materials such as tungsten nickel, lead, copper, iridium, or any other material with a high density may all be used without departing from the scope and content of the present invention. Lower density material mentioned above may generally be made out of materials such as 8620 steel, however numerous other materials such as aluminum, iron, copper, titanium, or even plastic may be used so long as it has a density lower than that of the denser material all without departing from the scope and content of the present invention.

Although the present embodiment shows three inserts in order to offer an ability to adjust the CG of the golf club head 2000, numerous other number combinations of inserts may be used without departing from the scope and content of the present invention. More specifically, the golf club head 2000 may have two inserts, four inserts, five inserts, or any number of inserts that can fit within the upper chamber 2062 all without departing from the scope and content of the present invention.

Figure 21:
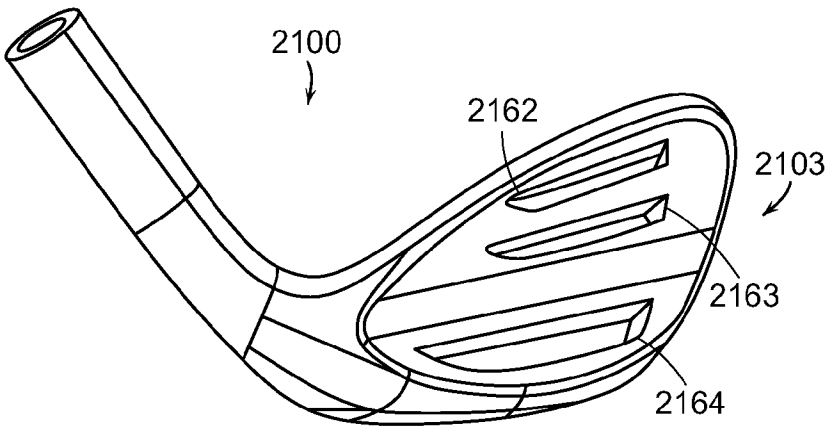
FIG. 21 shows a perspective view of a golf club head in accordance with a further alternative embodiment of the present invention.

FIG. 21 of the accompanying drawings shows a perspective view of a golf club head 2100 in accordance with a further alternative embodiment of the present invention wherein the backing portion 2103 of the golf club head 2100 may contain multiple chambers to help adjust the CG of the golf club head 2100. More specifically, golf club head 2100 may have an upper chamber 2162, a middle chamber 2163, and a lower chamber 2164 to provide a method of adjusting the CG of the golf club head 2100. Similar to the discussion above, different inserts being comprised out of a different material having different density to adjust the CG of the golf club head to change the performance characteristics of the golf club head 2100. Although FIG. 21 shows a golf club head 2100 with three distinct weight chambers, numerous other number of chambers may be used to alter the CG of the golf club head 2100 all without departing from the scope and content of the present invention.

Figure 22:
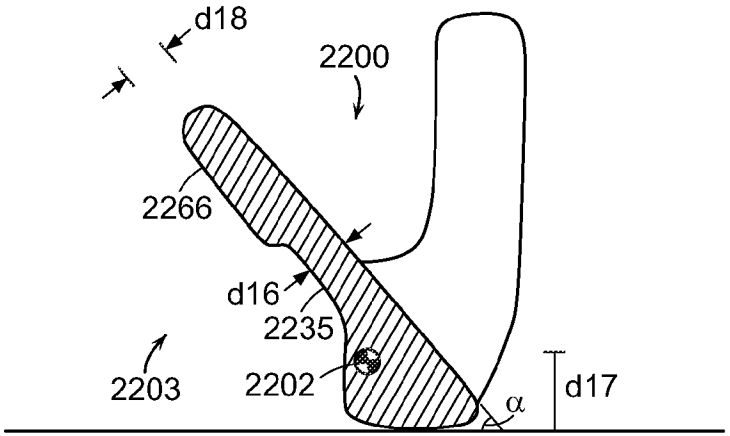
FIG. 22 shows a cross-sectional view of a golf club head in accordance with a further alternative embodiment of the present invention.

Finally, FIG. 22 shows a cross-sectional view of a golf club head 2200 in accordance with a further alternative embodiment of the present invention. More specifically, golf club head 2200 shown here may have a thickened topline portion 2266 and a thinned portion 2235. It should be noted that in this current exemplary embodiment of the present invention, the thickened topline portion 2266 may have a thickness of d18 and the thinned portion may have a thickness of d16 like previously discussed in FIG. 17. Thickness d18 may generally refer to the thickest area near the topline portion of the golf club head 2200 and thickness d16 may generally refer to the thinnest area near the central portion of the golf club head 2200.

Other than in the operating examples, or unless otherwise expressly specified, all of the numerical ranges, amounts, values and percentages such as those for amounts of materials, moment of inertias, center of gravity locations, loft and draft angles, and others in the preceding portions of the specification may be read as if prefaced by the word "about" even though the term "about" may not expressly appear with the value, amount, or range. Accordingly, unless indicated to the contrary, the numerical parameters set forth in the preceding specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited value may be used.

It should be understood, of course, that the foregoing relates to exemplary embodiments of the present invention and that modifications may be made without departing from the spirit and scope of the invention as set forth in the following claims.

What is claimed is:

1. A wedge type golf club head comprising:

a hosel;

a body attached to said hosel at a loft angle, wherein said body further comprises a hitting surface and a rear portion; and a sole at a bottom of said body at least partially resting on a ground, connecting said hitting surface to said rear portion, wherein said loft angle is greater than about 45 degrees;

wherein said rear portion further comprises a thickened topline portion having a first thickness and a thinned portion having a second thickness;

wherein said wedge type golf club head has a Topline Thickness Ratio of greater than about 6.0 degrees/mm and less than about 9.0 degrees/mm; said Topline Thickness Ratio defined as said loft angle of said wedge type golf club head divided by said first thickness of said thickened topline portion and;

wherein said wedge type golf club head has a center of gravity location that is between about 16 mm and about 20 mm away from said ground.

2. The wedge type golf club head of claim 1, wherein said Topline Thickness Ratio is greater than about 7.0 degrees/mm and less than about 9.0 degrees/mm.

3. The wedge type golf club head of claim 2, wherein said Topline Thickness Ratio is greater than about 8.0 degrees/mm and less than about 9.0 degrees/mm.

4. The wedge type golf club head of claim 1, wherein said wedge type golf club head has a Thickness Difference Ratio of greater than about 25 degrees/mm; said Thickness Difference Ratio defined as said loft angle of said wedge type golf club head divided by a difference between said first thickness and said second thickness.

5. The wedge type golf club head of claim 4, wherein said Thickness Difference Ratio is greater than about 27.5 degrees/mm.

6. The wedge type golf club head of claim 5, wherein said Thickness Difference Ratio is greater than about 30 degrees/mm.

7. The wedge type golf club head of claim 1, wherein said wedge type golf club head has a moment of inertia about an x-axis is greater than about 120 $kg*mm^2$.

8. The wedge type golf club head of claim 7, wherein said moment of inertia about said x-axis is greater than about 125 $kg*mm^2$.

9. The wedge type golf club head of claim 8, wherein said moment of inertia about said x-axis is greater than about 129 $kg*mm^2$.

10. The wedge type golf club head of claim 1, wherein said wedge type golf club head has a Performance Ratio of greater than about 530,000 rpm*mph;

wherein said Performance Ratio is defined as a launch angle multiplied by a ball speed multiplied by a backspin, all divided by said loft angle of said wedge type golf club head.

11. A wedge type golf club head comprising:

a hosel;

a body attached to said hosel at a loft angle, wherein said body further comprises a hitting surface and a rear portion; and a sole at a bottom of said body at least partially resting on a ground, connecting said hitting surface to said rear portion, wherein said loft angle is greater than about 45 degrees;

wherein said rear portion further comprises a thickened topline portion having a first thickness and a thinned portion having a second thickness;

wherein said wedge type golf club head has a moment of inertia about an x-axis is greater than about 125 $kg*mm^2$; and wherein said wedge type golf club head has a center of gravity location that is between about 16 mm and about 20 mm away from said ground.

12. The wedge type golf club head of claim 11, wherein said first thickness is greater than about 4.8 mm and less than about 7.32 mm.

13. The wedge type golf club head of claim 12, wherein said second thickness is less than about 6.5 mm.

14. The wedge type golf club head of claim 13, wherein said wedge type golf club head has a Thickness Difference Ratio of greater than about 25 degrees/mm; said Thickness Difference Ratio defined as said loft angle of said wedge type golf club head divided by a difference between said first thickness and said second thickness.

15. The wedge type golf club head of claim 13, wherein said wedge type golf club head has a Topline Thickness Ratio of greater than about 6.0 degrees/mm and less than about 9.0 degrees/mm; said Topline Thickness Ratio defined as said loft angle of said wedge type golf club head divided by said first thickness of said thickened topline portion.

16. A wedge type golf club head comprising:

a hosel;

a body attached to said hosel at a loft angle, wherein said body further comprises a hitting surface and a rear portion; and a sole at a bottom of said body at least partially resting on a ground, connecting said hitting surface to said rear portion, wherein said loft angle is greater than about 45 degrees;

wherein said rear portion further comprises a thickened topline portion having a first thickness and a thinned portion having a second thickness;

wherein said rear portion further comprises at least one hollow chamber;

wherein said wedge type golf club head has a Topline Thickness Ratio of greater than about 6.0 degrees/mm and less than about 9.0 degrees/mm; said Topline Thickness Ratio defined as said loft angle of said wedge type golf club head divided by said first thickness of said thickened topline portion and;

wherein said at least one hollow chamber is filled with a second material having a density greater than a density of a remainder of said wedge type golf club head.

17. The wedge type golf club head of claim 16, wherein a ratio of said density of said second material to said density for said remainder of said wedge type golf club head is greater than about 2.0.

* * * * *